US006054211A

United States Patent [19]

Fukuchi

[11] Patent Number: 6,054,211

[45] Date of Patent: Apr. 25, 2000

[54] LUBRICANT AND MAGNETIC RECORDING MEDIUM USING THE SAME

[75] Inventor: Takashi Fukuchi, Tokyo, Japan

[73] Assignee: NEC Corporation, Tokyo, Japan

[21] Appl. No.: 09/028,080

[22] Filed: Feb. 23, 1998

[30] Foreign Application Priority Data

Feb. 21, 1997 [JP] Japan ..... 9-038236

[51] Int. Cl.[7] ..... B32B 5/16

[52] U.S. Cl. ..... 428/336; 428/421; 428/694 TF; 428/694 TC; 428/900; 508/296; 508/298; 508/582

[58] Field of Search ..... 428/694 TF, 694 TC, 428/900, 421, 336; 508/296, 298, 582

[56] References Cited

U.S. PATENT DOCUMENTS

| | | | |
|---|---|---|---|
| 5,061,388 | 10/1991 | Nader | 200/47 |
| 5,071,715 | 12/1991 | Shoji et al. | 428/694 |
| 5,128,216 | 7/1992 | Ng | 428/695 |
| 5,147,567 | 9/1992 | Agarwala | 252/42.7 |
| 5,820,964 | 10/1998 | Nakakawaji et al. | 428/65.4 |

FOREIGN PATENT DOCUMENTS

| | | |
|---|---|---|
| 61-113130 | 5/1986 | Japan . |
| 5-20675 | 1/1993 | Japan . |
| 5-217152 | 8/1993 | Japan . |
| 6-145687 | 5/1994 | Japan . |
| 7-62738 | 3/1995 | Japan . |
| 7-93744 | 4/1995 | Japan . |
| 7-93745 | 4/1995 | Japan . |
| 7-182652 | 7/1995 | Japan . |
| 8-83423 | 3/1996 | Japan . |
| 9-50623 | 2/1997 | Japan . |

*Primary Examiner*—Stevan A. Resan

*Attorney, Agent, or Firm*—Sughrue, Mion, Zinn, Macpeak & Seas, PLLC

[57] ABSTRACT

A lubricant containing a perfluoropolyether compound and a magnetic recording medium using the same are disclosed. When the lubricant is applied to a magnetic disk, the chain decomposition of perfluoropolyether ascribable to hydrofluoric acid is reduced. In addition, the generation of a highly viscous substance is reduced.

8 Claims, 25 Drawing Sheets

Fig. 3

CONDITIONS FOR EVALUATION OF LUBRICATION

| | |
|---|---|
| PERFLUOROPOLYETHER COMPOUND | FONBRINE Z-DOL (MONTEFLUOS)<br>MAIN CHAIN : $-CF_2-(O-CF_2-CF_2)_p-(O-CF_2)_q-O-CF_2-$<br>TERMINAL GROUP (BOTH ENDS OF MAIN CHAIN) : $-CH_2OH$ |
| DISK | SUBSTRATE : 3.5", Al FULL-SURFACE TEXTURE, GH=1.5μ"<br>PROTECTION FILM : HYDROGEN-ADDED CARBON, 15nm<br>LUBRICANT FILM THICKNESS : 20A |
| SLIDER | 50%, 2 RAILS, $Al_2O_3$-TiC<br>ABS PROTECTION FILM : DLC, 10nm<br>LOAD : 3.5gf |
| DISK ROTATION | 3600rpm |
| SLIDER FLOAT | 5nm |
| ENVIRONMENT | TEMPERATURE : 60°C<br>HUMIDITY : 80% |

Fig. 4

EVALUATION ON RELATION BETWEEN ADDITIVE 1 AND LUBRICATION

| ADDITIVE CONCENTRATION | BEFORE CSS(μ) | AFTER CSS(μ) | DEPOSIT ON SLIDER |
|---|---|---|---|
| 0 % | 0.35 | 2.55 | 8 |
| 0.1 | 0.36 | 2.05 | 4 |
| 0.5 | 0.35 | 2.00 | 3 |
| 2.5 | 0.37 | 1.56 | 1 |
| 10 | 0.35 | 0.52 | 0 |
| 25 | 0.34 | 0.49 | 0 |
| 50 | 0.35 | 0.45 | 0 |

(ADDITION 2 CONCENTRATION WAS FIXED AT 0.000001%)

Fig. 5

EVALUATION ON RELATION BETWEEN KIND OF ADDITIVE 2 AND LUBRICATION

| EMBODIMENT | $R^1$ STRUCTURE | $R^2$ STRUCTURE | BEFORE CSS (μ) | AFTER CSS (μ) | DEPOSIT ON SLIDER |
|---|---|---|---|---|---|
| 1 | $-(CH_2)_{10}-CH_3$ | $=CH(CH_2)_{10}-CH_3$ | 0.37 | 0.68 | 1 |
| 2 | $-(CH_2)_{20}-CH_3$ | $=CH(CH_2)_{20}-CH_3$ | 0.34 | 0.67 | 1 |
| 3 | $-(CH_2)_{29}-CH_3$ | $=CH(CH_2)_{29}-CH_3$ | 0.34 | 0.59 | 2 |
| 4 | $-(CH_2)_{10}-CH_3$ | $=CH(CH_2)_{20}-CH_3$ | 0.37 | 0.65 | 1 |
| 5 | $-(CH_2)_{10}-CH_2-OH$ | $=CH(CH_2)_{20}-CH_2-NO_2$ | 0.36 | 0.52 | 1 |
| 6 | $-(CF_2)_{10}-CF_3$ | $=CF(CF_2)_{10}-CF_3$ | 0.34 | 0.46 | 0 |
| 7 | $-C_{10}H_5(-CH_2-CH_3)_2$ | $=CH-C_{10}H_5(-CH_3)_2$ | 0.35 | 0.45 | 2 |
| 8 | $-C_{30}F_{17}$ | $=CF-C_{30}F_{17}$ | 0.34 | 0.54 | 1 |
| 9 | $-(CF_2)_{10}-CH_3$ | $=CH-C_{10}H_5(-CH_3)_2$ | 0.36 | 0.55 | 0 |
| 10 | $-C_6H_5$ | $=CF-C_{30}F_{17}$ | 0.38 | 0.67 | 2 |
| 11 | $-C_{10}H_7$ | $=CF-C_{30}F_{17}$ | 0.37 | 0.56 | 0 |
| 12 | $-C_{14}H_9$ | $=CF-C_{30}F_{17}$ | 0.35 | 0.56 | 1 |
| 13 | $-C_6H_5$ | $=CH-C_{10}H_5(-CH_3)_2$ | 0.35 | 0.49 | 0 |
| 14 | $-C_6H_3-(OCH_3)_2$ | $=CF-C_{30}F_{17}$ | 0.35 | 0.44 | 1 |
| 15 | $-(CH_2)_{10}-CH_2-OH$ | $=CH-C_{10}H_5(-CH_3)_2$ | 0.35 | 0.45 | 0 |
| REFERENCE | — | — | 0.34 | 2.24 | 8 |

(ADDITIVE 1 CONCENTRATION AND ADDITIVE 2 CONCENTRATION WERE RESPECTIVELY FIXED AT 10% AND 0.000001%)

Fig. 6

CONDITIONS FOR EVALUATION OF LUBRICATION

| | |
|---|---|
| PERFLUOROPOLYETHER COMPOUND | FONBRINE AM-2001 (MONTEFLUOS)<br>MAIN CHAIN: $-CF_2-(O-CF_2-CF_2)_p-(O-CF_2)_q-O-CF_2-$<br>TERMINAL GROUP (BOTH ENDS OF MAIN CHAIN): PHENYL GROUP DERIVATIVE |
| DISK | SUBSTRATE: 3.5", Al FULL-SURFACE TEXTURE, GH=1.5 μ"<br>PROTECTION FILM: HYDROGEN-ADDED CARBON, 10nm<br>LUBRICANT FILM THICKNESS: 30A |
| SLIDER | 30%, 2 RAILS, $Al_2O_3$-TiC<br>ABS PROTECTION FILM: DLC, 10nm<br>LOAD: 1.0 gf |
| DISK ROTATION | 3600 rpm |
| SLIDER FLOAT | 15nm |
| ENVIRONMENT | TEMPERATURE: 60°C<br>HUMIDITY: 80% |

Fig. 7

EVALUATION ON RELATION BETWEEN ADDITIVE 1 AND LUBRICATION

| ADDITIVE CONCENTRATION | BEFORE CSS(μ) | AFTER CSS(μ) | DEPOSIT ON SLIDER |
|---|---|---|---|
| 0% | 0.35 | 2.55 | 8 |
| 0.1 | 0.36 | 2.05 | 4 |
| 0.5 | 0.35 | 2.00 | 3 |
| 2.5 | 0.37 | 1.56 | 1 |
| 10 | 0.35 | 0.52 | 0 |
| 25 | 0.34 | 0.49 | 0 |
| 50 | 0.35 | 0.45 | 0 |

(ADDITION 2 CONCENTRATION WAS FIXED AT 0.00001%)

Fig. 8

EVALUATION ON RELATION BETWEEN KIND OF ADDITIVE AND LUBRICATION

| EMBODIMENT | R STRUCTURE | BEFORE CSS(μ) | AFTER CSS(μ) | DEPOSIT ON SLIDER |
|---|---|---|---|---|
| 16 | $\equiv C(CH_2)_{10}-CH_3$ | 0.37 | 0.63 | 0 |
| 17 | $\equiv C(CH_2)_{20}-CH_3$ | 0.35 | 0.57 | 0 |
| 18 | $\equiv C(CH_2)_{29}-CH_3$ | 0.34 | 0.51 | 1 |
| 19 | $\equiv C(CH_2)_{10}-CH_3$ | 0.37 | 0.63 | 2 |
| 20 | $\equiv C(CH_2)_{10}-CH_2-OH$ | 0.37 | 0.50 | 1 |
| 21 | $\equiv C(CF_2)_{10}-CH_3$ | 0.34 | 0.66 | 0 |
| 22 | $\equiv C-C_{10}H_5(-CH_3)_2$ | 0.35 | 0.40 | 1 |
| 23 | $\equiv C-C_{30}F_{17}$ | 0.33 | 0.54 | 0 |
| 24 | $\equiv C(CF_2)_5-CF_3$ | 0.34 | 0.55 | 0 |
| 25 | $\equiv C(CF_2)_{10}-CF_3$ | 0.36 | 0.75 | 0 |
| REFERENCE | — | 0.35 | HEAD CRASH | 8 |
| CONVENTIONAL DISK | — | 0.34 | 2.69 | 8 |

(ADDITIVE 1 CONCENTRATION AND ADDITIVE 2 CONCENTRATION WERE RESPECTIVELY FIXED AT 10% AND 0.00001%)

Fig. 9

CONDITIONS FOR EVALUATION OF LUBRICATION

| | |
|---|---|
| PERFLUOROPOLYETHER COMPOUND | DEMNUM SP-3 (DAIKIN KOGYO)<br>MAIN CHAIN : F- $(CF_2-CF_2-CF_2)_p-CF_2-CF_2-CH_2-$<br>TERMINAL GROUP (BOTH ENDS OF MAIN CHAIN) : PHENYL GROUP DERIVATIVE |
| DISK | SUBSTRATE : 3.5", Al FULL-SURFACE TEXTURE, CH=1.5 μ"<br>PROTECTION FILM : HYDROGEN-ADDED CARBON, 15nm<br>LUBRICANT FILM THICKNESS : 20A |
| SLIDER | 50%, 2 RAILS, $Al_2O_3$-TiC<br>ABS PROTECTION FILM : DLC, 10nm<br>LOAD : 3.5gf |
| DISK ROTATION | 3600rpm |
| SLIDER FLOAT | 5nm |
| ENVIRONMENT | TEMPERATURE : 60°C<br>HUMIDITY : 80% |

Fig. 10

EVALUATION ON RELATION BETWEEN ADDITIVE 1 AND LUBRICATION

| ADDITIVE CONCENTRATION | BEFORE CSS(μ) | AFTER CSS(μ) | DEPOSIT ON SLIDER |
|---|---|---|---|
| 0% | 0.35 | 2.45 | 8 |
| 0.1 | 0.35 | 2.05 | 4 |
| 0.5 | 0.35 | 1.85 | 3 |
| 2.5 | 0.37 | 1.56 | 1 |
| 10 | 0.33 | 0.33 | 0 |
| 25 | 0.34 | 0.49 | 0 |
| 50 | 0.35 | 0.35 | 0 |

(ADDITIVE 2 CONCENTRATION WAS FIXED AT 0.0001%)

Fig. 11

EVALUATION ON RELATION BETWEEN KIND OF ADDITIVE AND LUBRICATION

| EMBODIMENT | $R^1$ STRUCTURE | $R^2$ STRUCTURE | $R^3$ STRUCTURE | $R^4$ STRUCTURE | BEFORE CSS (μ) | AFTER CSS (μ) | DEPOSIT ON SLIDER |
|---|---|---|---|---|---|---|---|
| 26 | $-(CH_2)_{10}-CH_3$ | $-(CH_2)_{10}-CH_3$ | $-(CH_2)_{10}-CH_3$ | $-(CH_2)_{10}-CH_3$ | 0.35 | 0.69 | 0 |
| 27 | $-(CH_2)_{20}-CH_3$ | $-(CH_2)_{20}-CH_3$ | $-(CH_2)_{20}-CH_3$ | $-(CH_2)_{20}-CH_3$ | 0.33 | 0.65 | 0 |
| 28 | $-(CH_2)_{29}-CH_3$ | $-(CH_2)_{29}-CH_3$ | $-(CH_2)_{29}-CH_3$ | $-(CH_2)_{29}-CH_3$ | 0.41 | 0.53 | 1 |
| 29 | $-(CH_2)_{10}-CH_3$ | $-(CH_2)_{20}-CH_3$ | $-(CH_2)_{29}-CH_3$ | $-(CH_2)_{10}-CH_2$ | 0.33 | 0.66 | 1 |
| 30 | $-(CH_2)_{10}-CH_2-OH$ | $-(CH_2)_{20}-CH_2-NO_2$ | $-(CH_2)_{29}-CH(CO)_2$ | $-(CH_2)_{10}-CH_2-OH$ | 0.32 | 0.59 | 1 |
| 31 | $-(CF_2)_{10}-CH_3$ | $-(CF_2)_{10}-CH_3$ | $-(CF_2)_{10}-CH_3$ | $-(CF_2)_{10}-CH_3$ | 0.32 | 0.45 | 0 |
| 32 | $-C_{10}H_5(-CH_2-CH_3)_2$ | $-C_{10}H_5(-CH_2-CH_3)_2$ | $-C_{10}H_5(-CH_2-CH_3)_2$ | $-C_{10}H_5(-CH_2-CH_3)_2$ | 0.31 | 0.44 | 3 |
| 33 | $-C_{30}F_{17}$ | $-C_{30}F_{17}$ | $-C_{30}F_{17}$ | $-C_{30}F_{17}$ | 0.31 | 0.52 | 1 |
| 34 | $-(CF_2)_{10}-CH_3$ | $-C_{10}H_5(-CH_2-CH_3)_2$ | $-C_{30}F_{17}$ | $-(CF_2)_{10}-CH_3$ | 0.35 | 0.48 | 0 |
| 35 | $-C_6H_5$ | $-C_6H_5$ | $-C_6H_5$ | $-C_6H_5$ | 0.37 | 0.51 | 1 |
| 36 | $-C_{10}H_7$ | $-C_{10}H_7$ | $-C_{10}H_7$ | $-C_{10}H_7$ | 0.34 | 0.55 | 2 |
| 37 | $-C_{14}H_9$ | $-C_{14}H_9$ | $-C_{14}H_9$ | $-C_{14}H_9$ | 0.32 | 0.62 | 2 |
| 38 | $-C_6F_5$ | $-C_{10}F_7$ | $-C_{14}F_9$ | $-C_6H_5$ | 0.31 | 0.45 | 0 |
| 39 | $-C_6H_3-(OCH_3)_2$ | $-C_{10}H_6-Cl$ | $-C_{14}H_7-(NO_2)(SO_3)$ | $-C_6H_3-(OCH_3)_2$ | 0.37 | 0.52 | 0 |
| 40 | $-(CH_2)_{10}-CH_2-OH$ | $-C_6H_5$ | $-C_{14}H_7-(NO_2)(SO_3)$ | $-(CH_2)_{10}-CH_2-OH$ | 0.41 | 0.51 | 1 |
| REFERENCE | — | — | — | — | 0.39 | HEAD CRASH | 8 |
| CONVENTIONAL DISK | — | — | — | — | 0.56 | HEAD CRASH | 8 |

(ADDITIVE 1 CONCENTRATION AND ADDITIVE 2 CONCENTRATION WERE RESPECTIVELY FIXED AT 10% AND 0.0001%)

Fig. 12

CONDITIONS FOR EVALUATION OF LUBRICATION

| | |
|---|---|
| PERFLUOROPOLYETHER COMPOUND | FONBRINE AM-2001 (MONTEFLUOS)<br>MAIN CHAIN: $-CF_2-(O-CF_2-CF_2)_p-(O-CF_2)_q-O-CF_2-$<br>TERMINAL GROUP(BOTH ENDS OF MAIN CHAIN): PHENYL GROUP DERIVATIVE |
| DISK | SUBSTRATE: 3.5", Al FULL-SURFACE TEXTURE, GH=1.5μ"<br>PROTECTION FILM: HYDROGEN-ADDED CARBON, 10nm<br>LUBRICANT FILM THICKNESS: 30A |
| SLIDER | 30%, 2 RAILS, $Al_2O_3$-TiC<br>ABS PROTECTION FILM: DLC, 10nm<br>LOAD: 1.0gf |
| DISK ROTATION | 3600rpm |
| SLIDER FLOAT | 15nm |
| ENVIRONMENT | TEMPERATURE: 60°C<br>HUMIDITY: 80% |

Fig. 13

EVALUATION ON RELATION BETWEEN ADDITIVE 1 AND LUBRICATION

| ADDITIVE CONCENTRATION | BEFORE CSS(μ) | AFTER CSS(μ) | DEPOSIT ON SLIDER |
|---|---|---|---|
| 0% | 0.38 | 2.85 | 8 |
| 0.1 | 0.35 | 2.05 | 3 |
| 0.5 | 0.33 | 1.83 | 3 |
| 2.5 | 0.37 | 1.56 | 1 |
| 10 | 0.35 | 0.53 | 0 |
| 25 | 0.34 | 0.49 | 0 |
| 50 | 0.38 | 0.38 | 0 |

(ADDITIVE 2 CONCENTRATION WAS FIXED AT 0.001%)

Fig. 14

EVALUATION ON RELATED BETWEEN KIND OF ADDITIVE AND LUBRICATION

| EMBODIMENT | $R^1$ STRUCTURE | $R^2$ STRUCTURE | $R^3$ STRUCTURE | $R^4$ STRUCTURE | $R^5$ STRUCTURE | BEFORE CSS (μ) | AFTER CSS (μ) | DEPOSIT ON SLIDER |
|---|---|---|---|---|---|---|---|---|
| 41 | $-(CH_2)_{10}-CH_3$ | $-(CH_2)_{10}-CH_3$ | $-(CH_2)_{10}-$ | $-(CH_2)_{10}-CH_3$ | $-(CH_2)_{10}-CH_3$ | 0.34 | 0.63 | 1 |
| 42 | $-(CH_2)_{20}-CH_3$ | $-(CH_2)_{20}-CH_3$ | $-(CH_2)_{20}-$ | $-(CH_2)_{20}-CH_3$ | $-(CH_2)_{20}-CH_3$ | 0.35 | 0.67 | 1 |
| 43 | $-(CH_2)_{29}-CH_3$ | $-(CH_2)_{29}-CH_3$ | $-(CH_2)_{29}-$ | $-(CH_2)_{29}-CH_3$ | $-(CH_2)_{29}-CH_3$ | 0.36 | 0.50 | 0 |
| 44 | $-(CH_2)_{10}-CH_3$ | $-(CH_2)_{20}-CH_3$ | $-(CH_2)_{29}-$ | $-(CH_2)_{10}-CH_3$ | $-(CH_2)_{29}-CH_3$ | 0.37 | 0.62 | 0 |
| 45 | $-(CH_2)_{10}-CH_2-OH$ | $-(CH_2)_{20}-CH_2-NO_2$ | $-(CH_2)_{29}-$ | $-(CH_2)_{10}-CH_2-OH$ | $-(CH_2)_{29}-CH(CO)_2$ | 0.36 | 0.52 | 0 |
| 46 | $-(CF_2)_{10}-CH_3$ | $-(CF_2)_{10}-CH_3$ | $-(CF_2)_{10}-$ | $-(CF_2)_{10}-CH_3$ | $-(CF_2)_{10}-CH_3$ | 0.32 | 0.44 | 0 |
| 47 | $-C_{10}H_5(-CH_2-CH_3)_2$ | $-C_{10}H_5(-CH_2-CH_3)_2$ | $-C_{10}H_5(-CH_3)_2CH_2$ | $-C_{10}H_5(-CH_2-CH_3)_2$ | $-C_{10}H_5(-CH_2-CH_3)_2$ | 0.34 | 0.45 | 3 |
| 48 | $-C_{30}F_{17}$ | $-C_{30}F_{17}$ | $-C_{30}F_{16}$ | $-C_{30}F_{17}$ | $-C_{30}F_{17}$ | 0.34 | 0.58 | 0 |
| 49 | $-(CF_2)_{10}-CH_3$ | $-C_{10}H_5(-CH_2-CH_3)_2$ | $-C_{30}F_{18}$ | $-(CF_2)_{10}-CH_3$ | $-C_{30}F_{17}$ | 0.37 | 0.45 | 1 |
| 50 | $-C_6H_5$ | $-C_6H_5$ | $-C_6H_4$ | $-C_6H_5$ | $-C_6H_5$ | 0.38 | 0.57 | 1 |
| 51 | $-C_{10}F_7$ | $-C_{10}F_7$ | $-C_{10}F_6$ | $-C_{10}H_7$ | $-C_{10}H_7$ | 0.38 | 0.56 | 0 |
| 52 | $-C_{14}H_9$ | $-C_{14}H_9$ | $-C_{14}H_8$ | $-C_{14}H_9$ | $-C_{14}H_9$ | 0.35 | 0.66 | 0 |
| 53 | $-C_6H_5$ | $-C_{10}H_7$ | $-C_{14}H_8$ | $-C_6H_5$ | $-C_{14}H_9$ | 0.35 | 0.49 | 0 |
| 54 | $-C_6H_3-(OCH_3)_2$ | $-C_{10}H_6-Cl$ | $-C_{14}H_6-(NO_2)(SO_3)$ | $-C_6H_3-(OCH_3)_2$ | $-C_{14}H_7-(NO_2)(SO_3)$ | 0.34 | 0.51 | 1 |
| 55 | $-(CH_2)_{10}-CH_2-OH$ | $-C_6H_5$ | $-C_{14}H_6-(NO_2)(SO_3)$ | $-(CH_2)_{10}-CH_2-OH$ | $-C_{14}H_7-(NO_2)(SO_3)$ | 0.35 | 0.51 | 3 |
| REFERENCE | — | — | — | — | — | 0.34 | HEAD CRASH | 8 |
| CONVENTIONAL DISK | — | — | — | — | — | 0.34 | 2.56 | 8 |

(ADDITIVE 1 CONCENTRATION AND ADDITIVE 2 CONCENTRATION WERE RESPECTIVELY FIXED AT 10% AND 0.001%)

Fig. 15

CONDITIONS FOR EVALUATION OF LUBRICATION

| | |
|---|---|
| PERFLUOROPOLYETHER COMPOUND | FONBRINE Z-DOL (MONTEFLUOS)<br>MAIN CHAIN: $-CF_2-(O-CF_2-CF_2)_p-(O-CF_2)_q-O-CF_2-$<br>TERMINAL GROUP (BOTH ENDS OF MAIN CHAIN): $-CH_2OH$ |
| DISK | SUBSTRATE: 3.5", Al FULL-SURFACE TEXTURE, GH = 1.5μ"<br>PROTECTION FILM: HYDROGEN-ADDED CARBON, 5nm<br>LUBRICANT FILM THICKNESS: 15A |
| SLIDER | 50%, 2 RAILS, $Al_2O_3$-TiC<br>ABS PROTECTION FILM: DLC, 10nm<br>LOAD: 3.5gf |
| DISK ROTATION | 3600rpm |
| SLIDER FLOAT | 5nm |
| ENVIRONMENT | TEMPERATURE: 60°C<br>HUMIDITY: 80% |

Fig. 16

EVALUATION ON RELATION BETWEEN ADDITIVE 1 AND LUBRICATION

| ADDITIVE CONCENTRATION | BEFORE CSS(μ) | AFTER CSS(μ) | DEPOSIT ON SLIDER |
|---|---|---|---|
| 0% | 0.38 | 2.85 | 8 |
| 0.1 | 0.30 | 2.11 | 3 |
| 0.5 | 0.37 | 1.83 | 3 |
| 2.5 | 0.37 | 1.50 | 0 |
| 10 | 0.39 | 0.53 | 0 |
| 25 | 0.35 | 0.47 | 0 |
| 50 | 0.38 | 0.38 | 0 |

(ADDITIVE 2 CONCENTRATION WAS FIXED AT 0.01%)

Fig. 17

EVALUATION ON RELATION BETWEEN KIND OF ADDITIVE AND LUBRICATION

| EMBODIMENT | $R^1$ STRUCTURE | $R^2$ STRUCTURE | BEFORE CSS (μ) | AFTER CSS (μ) | DEPOSIT ON SLIDER |
|---|---|---|---|---|---|
| 56 | $-(CH_2)_{10}-CH_3$ | $-(CH_2)_{10}-CH_3$ | 0.33 | 0.67 | 0 |
| 57 | $-(CH_2)_{20}-CH_3$ | $-(CH_2)_{20}-CH_3$ | 0.34 | 0.63 | 0 |
| 58 | $-(CF_2)_{29}-CH_3$ | $-(CF_2)_{29}-CH_3$ | 0.36 | 0.51 | 0 |
| 59 | $-(CH_2)_{10}-CH_3$ | $-(CH_2)_{20}-CH_3$ | 0.31 | 0.64 | 1 |
| 60 | $-(CH_2)_{10}-CH_2-OH$ | $-(CH_2)_{20}-CH_2-NO_2$ | 0.34 | 0.53 | 1 |
| 61 | $-(CF_2)_{10}-CF_3$ | $-(CF_2)_{10}-CF_3$ | 0.32 | 0.49 | 3 |
| 62 | $-C_{10}H_5(-CH_2-CH_3)_2$ | $-C_{10}H_5(-CH_3)_2$ | 0.35 | 0.46 | 0 |
| 63 | $-C_{30}F_{17}$ | $-C_{30}F_{17}$ | 0.32 | 0.56 | 0 |
| 64 | $-(CF_2)_{10}-CH_3$ | $-C_{10}H_5(-CH_3)_2$ | 0.38 | 0.54 | 1 |
| 65 | $-C_6H_5$ | $-C_{30}F_{17}$ | 0.34 | 0.62 | 0 |
| 66 | $-C_{10}H_7$ | $-C_{30}F_{17}$ | 0.32 | 0.57 | 0 |
| 67 | $-C_{14}H_9$ | $-C_{30}F_{17}$ | 0.35 | 0.51 | 0 |
| 68 | $-C_6H_5$ | $-C_{10}H_5(-CH_3)_2$ | 0.33 | 0.54 | 1 |
| 69 | $-C_6H_3-(OCH_3)_2$ | $-C_{30}F_{17}$ | 0.31 | 0.42 | 1 |
| 70 | $-(CH_2)_{10}-CH_2-OH$ | $-C_{10}H_5(-CH_3)_2$ | 0.37 | 0.44 | 0 |
| REFERENCE | — | — | 0.30 | 2.87 | 8 |
| CONVENTIONAL DISK | — | — | 0.39 | 3.56 | 9 |

(ADDITIVE 1 CONCENTRATION AND ADDITIVE 2 CONCENTRATION WERE FIXED AT 10% AND 0.01%)

Fig. 18

CONDITIONS FOR EVALUATION OF LUBRICATION

| | |
|---|---|
| PERFLUOROPOLYETHER COMPOUND | FONBRIN Z-DOL (MONTEFLUOS)<br>MAIN CHAIN: $-CF_2-(O-CF_2-CF_2)_p-(O-CF_2)_q-O-CF_2-$<br>TERMINAL GROUP (BOTH ENDS OF MAIN CHAIN): $-CH_2OH$ |
| DISK | SUBSTRATE: 3.5", Al FULL-SURFACE TEXTURE, GH=1.5μ"<br>PROTECTION FILM: HYDROGEN-ADDED CARBON, 15nm<br>LUBRICANT FILM THICKNESS: 20A |
| SLIDER | 50%, 2 RAILS, $Al_2O_3$-TiC<br>ABS PROTECTION FILM: DLC, 10nm<br>LOAD: 3.5gf |
| DISK ROTATION | 3600rpm |
| SLIDER FLOAT | 5nm |
| ENVIRONMENT | TEMPERATURE: 60°C<br>HUMIDITY: 80% |

Fig. 19

EVALUATION ON RELATION BETWEEN ADDITIVE 1 AND LUBRICATION

| ADDITIVE CONCENTRATION | BEFORE CSS(μ) | AFTER CSS(μ) | DEPOSIT ON SLIDER |
|---|---|---|---|
| 0% | 0.38 | 2.85 | 8 |
| 0.1 | 0.30 | 2.11 | 3 |
| 0.5 | 0.37 | 1.83 | 3 |
| 2.5 | 0.37 | 1.50 | 0 |
| 10 | 0.39 | 0.53 | 0 |
| 25 | 0.35 | 0.47 | 0 |
| 50 | 0.38 | 0.38 | 0 |

(ADDITIVE 2 CONCENTRATION WAS FIXED AT 0.1%)

Fig. 20

EVALUATION ON RELATION BETWEEN KIND OF ADDITIVE 2 AND LUBRICATION

| EMBODIMENT | R STRUCTURE | BEFORE CSS(μ) | AFTER CSS(μ) | DEPOSIT ON SLIDER |
|---|---|---|---|---|
| 71 | $=CH(CH_2)_{10}-CH_3$ | 0.37 | 0.63 | 0 |
| 72 | $=CH(CH_2)_{20}-CH_3$ | 0.35 | 0.57 | 0 |
| 73 | $=CH(CH_2)_{29}-CH_3$ | 0.34 | 0.51 | 1 |
| 74 | $=CH(CH_2)_{10}-CH_3$ | 0.37 | 0.63 | 2 |
| 75 | $=CH(CH_2)_{10}-CH_2-OH$ | 0.37 | 0.50 | 1 |
| 76 | $=CH(CF_2)_{10}-CH_3$ | 0.34 | 0.66 | 0 |
| 77 | $=CH-C_{10}H_5(-CH_3)_2$ | 0.35 | 0.40 | 1 |
| 78 | $=CF-C_{30}F_{17}$ | 0.33 | 0.54 | 0 |
| 79 | $=CF(CF_2)_5-CF_3$ | 0.34 | 0.55 | 0 |
| 80 | $=CF(CF_2)_{10}-CF_3$ | 0.36 | 0.75 | 0 |
| REFERENCE | — | 0.35 | HEAD CRASH | 8 |
| CONVENTIONAL DISK | — | 0.34 | 2.69 | 8 |

(ADDITIVE 1 CONCENTRATION AND ADDITIVE 2 CONCENTRATION WERE RESPECTIVELY FIXED AT 10% AND 0.1%)

Fig. 21

CONDITIONS FOR EVALUATION OF LUBRICATION

| | |
|---|---|
| PERFLUOROPOLYETHER COMPOUND | FONBRINE Z-DOL (MONTEFLUOS)<br>MAIN CHAIN: $-CF_2-(O-CF_2-CF_2)_p-(O-CF_2)_q-O-CF_2-$<br>TERMINAL GROUP (BOTH ENDS OF MAIN CHAIN): $-CH_2OH$ |
| DISK | SUBSTRATE: 3.5", Al FULL-SURFACE TEXTURE, GH=1.5μ"<br>PROTECTION FILM: HYDROGEN-ADDED CARBON, 5nm<br>LUBRICANT FILM THICKNESS: 15A |
| SLIDER | 50%, 2 RAILS, $Al_2O_3$-Tic<br>ABS PROTECTION FILM: DLC, 10nm<br>LOAD: 3.5gf |
| DISK ROTATION | 3600rpm |
| SLIDER FLOAT | 5nm |
| ENVIRONMENT | TEMPERATURE: 60°C<br>HUMIDITY: 80% |

Fig. 22

EVALUATION ON RELATION BETWEEN ADDITIVE 1 AND LUBRICATION

| ADDITIVE CONCENTRATION | BEFORE CSS(μ) | AFTER CSS(μ) | DEPOSIT ON SLIDER |
|---|---|---|---|
| 0% | 0.35 | 2.45 | 8 |
| 0.1 | 0.30 | 2.15 | 4 |
| 0.5 | 0.32 | 1.88 | 3 |
| 2.5 | 0.37 | 1.41 | 1 |
| 10 | 0.35 | 0.53 | 0 |
| 25 | 0.35 | 0.45 | 0 |
| 50 | 0.34 | 0.39 | 0 |

(ADDITIVE 2 CONCENTRATION WAS FIXED AT 1%)

Fig. 23

EVALUATION ON RELATION BETWEEN KIND OF ADDITIVE 2 AND LUBRICATION

| EMBODIMENT | $R^1$ STRUCTURE | $R^2$ STRUCTURE | BEFORE CSS (μ) | AFTER CSS (μ) | DEPOSIT ON SLIDER |
|---|---|---|---|---|---|
| 81 | $-(CH_2)_{10}-CH_3$ | $-(CH_2)_{10}-CH_3$ | 0.33 | 0.67 | 0 |
| 82 | $-(CH_2)_{20}-CH_3$ | $-(CH_2)_{20}-CH_3$ | 0.34 | 0.63 | 0 |
| 83 | $-(CF_2)_{29}-CH_3$ | $-(CF_2)_{29}-CH_3$ | 0.36 | 0.51 | 0 |
| 84 | $-(CH_2)_{10}-CH_3$ | $-(CH_2)_{20}-CH_3$ | 0.31 | 0.64 | 1 |
| 85 | $-(CH_2)_{10}-CH_2-OH$ | $-(CH_2)_{20}-CH_2-NO_2$ | 0.34 | 0.53 | 1 |
| 86 | $-(CF_2)_{10}-CF_3$ | $-(CF_2)_{10}-CF_3$ | 0.32 | 0.49 | 3 |
| 87 | $-C_{10}H_5(-CH_2-CH_3)_2$ | $-C_{10}H_5(-CH_3)_2$ | 0.35 | 0.46 | 0 |
| 88 | $-C_{30}F_{17}$ | $-C_{30}F_{17}$ | 0.32 | 0.56 | 0 |
| 89 | $-(CF_2)_{10}-CH_3$ | $-C_{10}H_5(-CH_3)_2$ | 0.38 | 0.54 | 1 |
| 90 | $-C_6H_5$ | $-C_{30}F_{17}$ | 0.34 | 0.62 | 0 |
| 91 | $-C_{10}H_7$ | $-C_{30}F_{17}$ | 0.32 | 0.57 | 0 |
| 92 | $-C_{14}H_9$ | $-C_{30}F_{17}$ | 0.35 | 0.51 | 0 |
| 93 | $-C_6H_5$ | $-C_{10}H_5(-CH_3)_2$ | 0.33 | 0.54 | 1 |
| 94 | $-C_6H_3-(OCH_3)_2$ | $-C_{30}F_{17}$ | 0.31 | 0.42 | 1 |
| 95 | $-(CH_2)_{10}-CH_2-OH$ | $-C_{10}H_5(-CH_3)_2$ | 0.37 | 0.44 | 0 |
| REFERENCE | — | — | 0.30 | 2.87 | 8 |
| CONVENTIONAL DISK | — | — | 0.39 | 3.56 | 9 |

(ADDITIVE 1 CONCENTRATION AND ADDITIVE 2 CONCENTRATION WERE RESPECTIVELY FIXED AT 10% AND 1%)

Fig. 24

CONDITIONS FOR EVALUATION OF LUBRICATION

| | |
|---|---|
| PERFLUOROPOLYETHER COMPOUND | FONBRINE AM-2001 (MONTEFLUOS)<br>MAIN CHAIN: $-CF_2-(O-CF_2-CF_2)_p-(O-CF_2)_q-O-CF_2-$<br>TERMINAL GROUP (BOTH ENDS OF MAIN CHAIN): PHENYL GROUP DERIVATIVE |
| DISK | SUBSTRATE: 3.5", Al FULL-SURFACE TEXTURE, GH=1.5"<br>PROTECTION FILM: HYDROGEN-ADDED CARBON, 10nm<br>LUBRICANT FILM THICKNESS: 30A |
| SLIDER | 30%, 2 RAILS, $Al_2O_3$-TiC<br>ABS PROTECTION FILM: DLC, 10nm<br>LOAD: 1.0 gf |
| DISK ROTATION | 3600rpm |
| SLIDER FLOAT | 15nm |
| ENVIRONMENT | TEMPERATURE: 60°C<br>HUMIDITY: 80% |

Fig. 25

EVALUATION ON RELATION BETWEEN ADDITIVE 1 AND LUBRICATION

| ADDITIVE CONCENTRATION | BEFORE CSS(μ) | AFTER CSS(μ) | DEPOSIT ON SLIDER |
|---|---|---|---|
| 0% | 0.35 | 2.45 | 8 |
| 0.1 | 0.32 | 2.15 | 5 |
| 0.5 | 0.35 | 1.79 | 3 |
| 2.5 | 0.34 | 1.43 | 1 |
| 10 | 0.38 | 0.52 | 1 |
| 25 | 0.30 | 0.40 | 0 |
| 50 | 0.36 | 0.38 | 0 |

(ADDITIVE 2 CONCENTRATION WAS FIXED AT 10%)

Fig. 26

EVALUATION ON RELATION BETWEEN KIND OF ADDITIVE 2 AND LUBRICATION

| EMBODIMENT | $R^1$ STRUCTURE | $R^2$ STRUCTURE | $R^3$ STRUCTURE | BEFORE CSS (μ) | AFTER CSS (μ) | DEPOSIT ON SLIDER |
|---|---|---|---|---|---|---|
| 96 | $-(CH_2)_{10}-CH_3$ | $-(CH_2)_{10}-$ | $-(CH_2)_{10}-CH_3$ | 0.36 | 0.72 | 1 |
| 97 | $-(CH_2)_{20}-CH_3$ | $-(CH_2)_{20}-$ | $-(CH_2)_{20}-CH_3$ | 0.44 | 0.61 | 1 |
| 98 | $-(CH_2)_{29}-CH_3$ | $-(CH_2)_{29}-$ | $-(CH_2)_{29}-CH_3$ | 0.35 | 0.56 | 1 |
| 99 | $-(CH_2)_{10}-CH_3$ | $-(CF_2)_{10}-$ | $-(CH_2)_{29}-CH_3$ | 0.47 | 0.76 | 0 |
| 100 | $-(CH_2)_{10}-CH_2-OH$ | $-(CF_2)_{20}-$ | $-(CH_2)_{29}-CH(CO)_2$ | 0.37 | 0.52 | 0 |
| 101 | $-(CF_2)_{10}-CH_3$ | $-(CF_2)_{29}-$ | $-(CF_2)_{10}-CH_3$ | 0.44 | 0.69 | 0 |
| 102 | $-C_{10}H_5(-CH_2-CH_3)_2$ | $-(CH=CH-)_5-$ | $-C_{10}H_5(-CH_2-CH_3)_2$ | 0.34 | 0.45 | 0 |
| 103 | $-C_{30}F_{17}$ | $-(CH=CH-)_{10}-$ | $-C_{30}F_{17}$ | 0.34 | 0.65 | 0 |
| 104 | $-(CF_2)_{10}-CH_3$ | $-(CH=CH-)_{29}-$ | $-C_{30}F_{17}$ | 0.43 | 0.55 | 0 |
| 105 | $-C_6H_5$ | $-(CF=CF-)_5-$ | $-C_6H_5$ | 0.38 | 0.66 | 0 |
| 106 | $-C_{10}H_7$ | $-(CF=CF-)_{10}-$ | $-C_{10}H_7$ | 0.36 | 0.56 | 0 |
| 107 | $-C_{14}H_9$ | $-(CF=CF-)_{29}-$ | $-C_{14}H_9$ | 0.35 | 0.36 | 2 |
| 108 | $-C_6H_5$ | $-C_6H_4-$ | $-C_{14}H_9$ | 0.36 | 0.49 | 1 |
| 109 | $-C_6H_3-(OCH_3)_2$ | $-C_6H_4-$ | $-C_{14}H_7-(NO_2)(SO_3)$ | 0.35 | 0.46 | 0 |
| 110 | $-(CH_2)_{10}-CH_2-OH$ | $-C_6H_4-$ | $-C_{14}H_7-(NO_2)(SO_3)$ | 0.38 | 0.45 | 1 |
| REFERENCE | — | — | — | 0.35 | 1.99 | 8 |

(ADDITIVE 1 CONCENTRATION AND ADDITIVE 2 CONCENTRATION WERE BOTH FIXED AT 10%)

LUBRICANT AND MAGNETIC RECORDING MEDIUM USING THE SAME

BACKGROUND OF THE INVENTION

The present invention relates to a lubricant containing a perfluoropolyether compound, and a magnetic recording medium using the same.

To meet the increasing demand for small size, large capacity hard disk drives, researches and developments for high density recording are under way. High density recording with a head and disk system is achievable if the distance between a head and a disk is reduced and if the spinning speed of the disk is increased. This, however, increases the probability of high-speed contact of the disk with a slider supporting the head and thereby deteriorates a lubricant, resulting in various kinds of troubles. I found, based on a series of studies and experiments, that a lubricant deteriorates generally in two different modes, one ascribable to the decomposition of perfluoropolyether contained in the lubricant and the other ascribable to the generation of a highly viscous substance.

The decomposition of perfluoropolyether is generally classified into thermal decomposition and chemical decomposition. Thermal decomposition is caused by frictional heat ascribable to the high-speed contact of the slider and disk. Chemical decomposition is ascribable to chemical reaction between perfluoropolyether and $Al_2O_3$—TiC constituting the slider or acids derived from perfluoropolyether. A lubricant capable of reducing the thermal decomposition of perfluoropolyether and the chemical decomposition ascribable to the reaction of perfluoropolyether with $Al_2O_3$—TiC has not been reported in the past.

A lubricant capable of reducing the decomposition of perfluoropolyether ascribable to its reaction with acids has been proposed in various forms. For example, perfluoropolyether with tri-alkylamine added thereto is taught in, e.g., Japanese Patent Laid-Open Publication Nos. 5-20675, 6-145687, 7-62738, 7-93744, and 7-93745. Among them, Laid-Open Publication No. 5-20675 relates to a lubricant with tri-alkylamine added to perfluoropolyether having a hydroxyl group at its end. This document teaches that tri-alkylamine may be either one of straight chain type and branched type, but should preferably have six or more carbons, and that such a lubricant implements desirable lubrication, e.g., smooth running, wear resistance and durability over a long period of time. I actually confirmed that so long as this kind of lubricant is applied to audio tapes, video tapes and other magnetic tapes, the decomposition of perfluoropolyether is slow enough to enhance the performance including smooth running.

However, when it comes to advanced hard disk drives causing disks to spin at a speed of 7,200 rpm (revolutions per minute) or above, none of the conventional lubricants including one taught in Laid-Open Publication No. 5-20675 can reduce the decomposition of perfluoropolyether or prevent the lubricating ability from being lowered.

Why the lubricant containing perfluoropolyether having a hydroxyl group at its end and tri-alkylamine added thereto preserves desirable lubrication over a long period time is presumably as follows. The lubricant neutralizes, with tri-alkylamine, acids (mainly carboxylic acid) generated therein by thermal decomposition ascribable to sliding and playing the role of a catalyst for the decomposition of perfluoropolyether, thereby cancelling the catalytic action. However, in the case of a hard disk, acids (mainly hydrofluoric acid) to be generated by sliding are different from acids derived from a magnetic tape and cannot be fully neutralized by alkylamine. Moreover, the acids particular to a hard disk are several hundred to several ten thousand times as high in density as the acids particular to a magnetic tape.

Truly effective means for reducing the decomposition of perfluoropolyether under the above severe conditions has not been reported yet. Further, an implementation for reducing the decomposition of perfluoropolyether ascribable to its reaction with $Al_2O_3$—TiC is now known at all.

The highly viscous substance derived from the deterioration of the lubricant is a more critical cause of troubles between the head and the disk. This kind of substance is a denaturated substance mainly constituted by a complex compound of a decomposed substance derived from perfluoropolyether and metal ions. Cobalt which is the major component of a magnetic recording layer is present, although in a small amount, on the protection layer of a disk, as well known in the art. Such cobalt is ionized by the hydrofluoric acid derived from perfluoropolyether, causing the complex compound formation to proceed. Should the viscous substance deposit on a slider, it would cause the aerodynamic characteristic and therefore the float, pitch angle and roll angle of the slider to change. This aggravates the error rate at the time of recording or reproduction and the probability of high-speed contact of the slider and disk, and causes the slider edge and disk to slide on each other at a high speed, bringing about head crashes in a short period of time.

While the above problems may be effectively solved by a lubricant of the kind generating no highly viscous substances despite the high speed contact of the slider and disk, such a lubricant is not known in the art.

Technologies relating to the present invention are also disclosed in, e.g., Japanese Patent Laid-Open Publication Nos. 61-113130, 5-217152, 7-182652, and 8-83423.

SUMMARY OF THE INVENTION

It is therefore an object of the present invention to reduce the decomposition of a lubricant and the generation of a highly viscous substance ascribable to the high-speed contact of a magnetic disk and a slider supporting a head.

In accordance with the present invention, in a lubricant for a magnetic recording medium, a perfluoropolyether compound contains 0.1 wt % to 50 wt % of one or more of porphyrin, phthalocyanine and derivatives thereof, and 0.000001 wt % to 10 wt % of a substance reacting with hydrofluoric acid (HF) at a higher rate than a reaction rate between HF and perfluoropolyether and having a greater complex generation constant than perfluoropolyether with respect to metal ions.

BRIEF DESCRIPTION OF THE DRAWINGS

The above and other objects, features and advantages of the present invention will become apparent from the following detailed description taken with the accompanying drawings in which:

FIG. 3 shows conditions under which Embodiments 1–15 of the present invention were tested for evaluation;

FIG. 4 shows the results of evaluation effected with Embodiments 1–15 as to a relation between the concentration of an additive 1 and the lubricating ability;

FIG. 5 shows the results of evaluation also effected with Embodiments 1–15 as to a relation between the kind of an additive 2 and the lubricating ability;

FIG. 6 shows conditions under which Embodiments 16–25 of the present invention were tested for evaluation;

FIG. 7 shows the results of evaluation effected with Embodiments 16–25 as to a relation between the concentration of an additive 1 and the lubricating ability;

FIG. 8 shows the results of evaluation also effected with Embodiments 16–25 as to a relation between the kind of an additive and the lubricating ability;

FIG. 9 shows conditions under which Embodiments 26–40 of the present invention were tested for evaluation;

FIG. 10 shows the results of evaluation effected with Embodiments 26–40 as to a relation between the concentration of an additive 1 and the lubricating ability;

FIG. 11 shows the results of evaluation also effected with Embodiments 26–40 as to a relation between the kind of an additive and the lubricating ability;

FIG. 12 shows conditions under which Embodiments 41–55 of the present invention were tested for evaluation;

FIG. 13 shows the results of evaluation effected with Embodiments 41–55 as to a relation between the concentration of an additive 1 and the lubricating ability;

FIG. 14 shows the results of evaluation also effected with Embodiments 41–55 as to a relation between the kind o an additive and the lubricating ability;

FIG. 15 shows conditions under which Embodiments 56–70 of the present invention were tested for evaluation;

FIG. 16 shows the results of evaluation effected with Embodiments 56–70 as to a relation between the concentration of an additive 1 and the lubricating ability;

FIG. 17 shows the results of evaluation also effected with Embodiments 56–70 as to a relation between the kind of an additive and the lubricating ability;

FIG. 18 shows conditions under which Embodiments 71–80 of the present invention were tested for evaluation;

FIG. 19 shows the results of evaluation effected with Embodiments 71–80 as to a relation between the concentration of an additive 1 and the lubricating ability;

FIG. 20 shows the results of evaluation also effected with Embodiments 71–80 as to a relation between the kind of an additive and the lubricating ability;

FIG. 21 shows conditions under which Embodiments 81–95 of the present invention were tested for evaluation;

FIG. 22 shows the results of evaluation effected with Embodiments 81–95 as to a relation between the concentration of an additive 1 and the lubricating ability;

FIG. 23 shows the results of evaluation also effected with Embodiments 81–95 as to a relation between the kind of an additive and the lubricating ability;

FIG. 24 shows conditions under which Embodiments 96–110 of the present invention were tested for evaluation;

FIG. 25 shows the results of evaluation effected with Embodiments 96–110 as to a relation between the concentration of an additive 1 and the lubricating ability; and FIG. 26 shows the results of evaluation also effected with Embodiments 96–110 as to a relation between the kind of an additive and the lubricating ability

DESCRIPTION OF THE PREFERRED EMBODIMENTS

Figure 1:
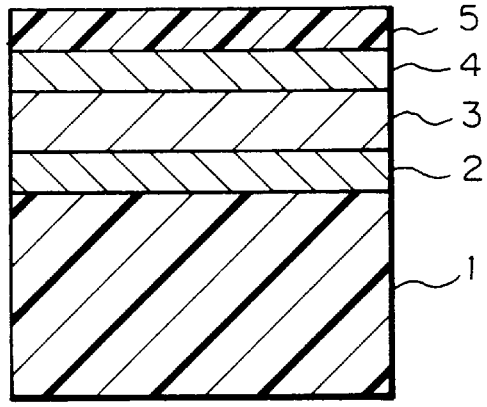
FIG. 1 is a fragmentary section showing a magnetic recording medium in accordance with the present invention.

I conducted extended studies and experiments in order to achieve the above object and found that perfluoropolyether constituting a lubricant is decomposed by thermal reaction ascribable to friction and chemical decomposition ascribable to its reaction with acids and Lewis acids including $Al_2O_3$—TiC.

Thermal decomposition is such that the ether linkage of the main chain of perfluoropolyether breaks up at 150° C. or above. While two fluorines are released due to the decomposition of the ether linkage, such fluorine radicals react with water molecules and turn out hydrofluoric acid (HF).

Chemical decomposition is ascribable to the reaction of perfluoropolyether with the above HF. Specifically, $H^+$ from HF attacks ether oxygen of the main chain and thereby causes ether cleavage to occur. This also occurs when perfluoropolyether reacts with $Al_2O_3$—TiC constituting a slider. During chemical decomposition, two-molecule HF is newly generated, as during thermal decomposition. That is, perfluoropolyether once decomposed in contact with $Al_2O_3$—TiC repeats chemical decomposition chain reaction catalyzed by HF.

A highly viscous substance is formed by the fragments of perfluoropolyether undergone ether cleavage and forming a complex compound with metal ions. Metal ions are generated because the metal component of a magnetic recording layer is scattered to the surface of a recording medium via a protection layer and because the magnetic recording layer exposed due to wear, cracking or peeling reacts with HF of the lubricant.

To reduce the linked chemical decomposition of lubricant molecules and the generation of a metal complex, it is considered effective to obstruct the reaction of HF, $Al_2O_3$—TiC and metal ions with perfluoropolyether. Specifically, if a substance reacting with HF derived from the high-speed contact of the slider and disk at a sufficiently higher rate than perfluoropolyether is added, it will successfully reduce the reaction between HF and perfluoropolyether to a negligible degree. Further, if a substance capable of depositing on the surface of $Al_2O_3$—TiC is added, it will prevent $Al_2O_3$—TiC and perfluoropolyether from contacting each other and will therefore obstruct the decomposition.

Moreover, as for the formation of the highly viscous substance, if a substance sufficiently greater in complex formation constant than perfluoropolyether with respect to metal ions is added, it will reduce even the reaction between metal ions and perfluoropolyether to a negligible degree.

The present invention with the above point of view presents a formula representative of a substance capable of depositing on the surface of $Al_2O_3$—TiC so as to prevent it from contacting perfluoropolyether, presents a formula representative of a substance having a complex formation constant several ten to several ten thousand times greater than that of perfluoropolyether with respect to metal ions, and proposes a new lubricant with such components added to perfluoropolyether.

When the above new lubricant was applied to a magnetic recording disk, the linked chemical decomposition of perfluoropolyether and the formation of the highly viscous substance were reduced even under conditions liable to cause a slider and a disk to contact at a high speed. Stated another way, from the performance standpoint, the lubricant caused the coefficient of friction ($\mu$) to change little, as determined by CSS (Contact Start and Stop) tests, and reduced the amount of the highly viscous substance to deposit on the head slider, as determined by seek tests.

The lubricant of the present invention is particularly feasible for a contact type or near-contact type magnetic recording apparatus causing a head and a medium to slide in contact with each other and being actively studied in the magnetic recording art. In a floating or flying head type magnetic recording apparatus, a head does not contact a disk while the disk is in rotation. By contrast, in the contact or near-contact type recording apparatus, the duration over which a head and the surface of a spinning disk contact is continuous, so that the friction between the head and the disk is a critical problem. In this respect, the lubricant of the present invention is advantageously applicable to the contact or near-contact type recording apparatus. Further, the lubricant was found to realize desirable performance, including smooth running, wear resistance and durability, when applied to floppy disks, audio tapes, and video tapes.

The perfluoropolyether compound which is the major component of the present invention has a main chain exemplarily represented by any one of the following formulae:

$$—CF_2—(O—CF_2—CF_2)p—(O—CF_2)q—O—CF_2— \quad \text{Formula [11]}$$

$$F—(CF_2—CF_2—CF_2)n—CF_2—CF_2— \quad \text{Formula [12]}$$

$$CF_3—(O—CF—(CF_3)—CF_2)m—(O—CF_2)l— \quad \text{Formula [13]}$$

where p, q, n, m and l each is 1 or greater integer. However, the structure of the main chain is not limited to the above formulae. The terminal functional group may be, but not limited to, $—CH_2OH$, —OH, $—CH_2COOH$, —COOH, $—C_6H_5$ or condensed ring group by way of example. The preferable range of molecular weight is from 2,000 to 4,000 although it is open to choice.

The components of the present invention other than perfluoropolyether have the following skeleton:

Formula [1]

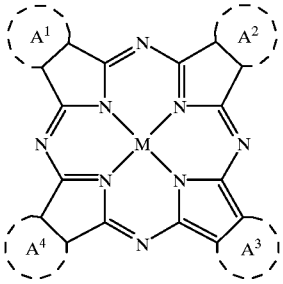

In the above Formula [1], M denotes one metal ion or two hydrogen ions. $A^1$–$A^4$ each denotes independently of the others a condensed polycyclic compound residual group containing either cyclic ketone or cyclic secondary amine in which a carbonyl group or an imino group is substituted for at least one methine carbon atom contained in a condensed polycyclic compound residual group of one or more benzene rings and a benzene ring, naphthalene ring, acenaphthylene ring, fluorene ring, phenalene ring, anthracene ring, fluoranthene ring, acephenanthrylene ring, triphenine ring, pyrene ring, chrysene ring, naphthacene ring, pleiadene ring, picene ring, perillene ring, pentaphene ring, pentacene ring, hexene ring, chlonene ring or heptacene ring or a compound residual group thereof. Alternatively, $A^1$–$A^4$ may each denote independently of the others a complex cyclic compound residual group in which the methine carbon atom of the condensed cyclic compound residual group is replaced with one or more nitrogen atoms, oxygen atoms or sulfur atoms of the same or different kinds. Further, the hydrogen atoms of the condensed polycyclic compound residual group or those of the heterocyclic compound residual group may be replaced with an alkyl group or an aryl group. The alkyl group or the aryl group may include a substituent, and the hydrogen atoms may be partly or entirely replaced with fluorine atoms.

Formula [2]

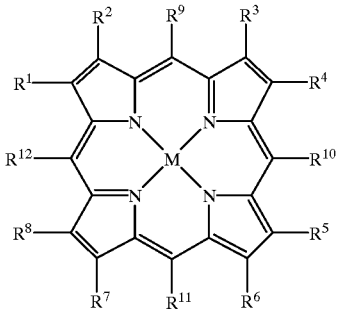

where $R^1$–$R^{12}$ each denotes one of a hydrogen atom, an alkyl atom, and an aryl atom. Such an alkyl group or an aryl group may contain a substituent, and the hydrogen atoms may be partly or entirely replaced with fluorine atoms.

Formula [3]

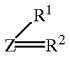

where Z denotes a nitrogen atom or a phosphor atom, and $R^1$ denotes a hydrogen atom, an alkyl group or an aryl group. The alkyl group or the aryl group may contain a substituent, and hydrogen atoms may be partly or entirely replaced with fluorine atoms. In the above Formula [3], $R^2$ denotes an alkyl group or an aryl group which may contain a substituent; hydrogen atoms may be partly or entirely replaced with fluorine atoms.

$$Z{\equiv}R \quad \text{Formula [4]}$$

where Z denotes a nitrogen atom or a phosphor atom, and R denotes an alkyl group or an aryl group. The alkyl group or the aryl group may contain a substituent, and hydrogen atoms may be partly or entirely replaced with fluorine atoms.

Formula [5]

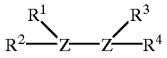

where Zs each denotes a nitrogen atom or a phosphor atom independently of the other, and $R^1$–$R^4$ each denotes a hydrogen atom, an alkyl group or an aryl group independently of the others. The alkyl group or the aryl group may contain a substituent, and hydrogen atoms may be partly or entirely replaced with fluorine atoms.

Formula [6]

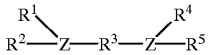

where Zs each denote a nitrogen atom or a phosphor atom independently of the other, and $R^1$–$R^5$ each denotes an alkyl group or an aryl group independently of the others. $R^1$, $R^2$, $R^4$ and $R^5$ may each be a hydrogen atom. The alkyl group or the aryl group may each contain a substituent, and hydrogen atoms may be partly or entirely replaced with fluorine atoms.

$R^1—Z—R^2$ Formula [7]

where Z denotes an oxygen atom or a sulfur atom, and $R^1$ and $R^2$ each denotes a hydrogen atom, an alkyl group or an aryl group independently of the other. The alkyl group or the aryl group may contain a substituent, and hydrogen atoms may be partly or entirely replaced with fluorine atoms.

Z=R Formula [8]

where Z denotes an oxygen atom or a sulfur atom, and R denotes an alkyl group or an aryl group. The alkyl group or the aryl group may contain a substituent, and hydrogen atoms may be partly or entirely replaced with fluorine atoms.

$R^1—Z—Z—R^2$ Formula [9]

where Zs each denotes an oxygen atom or a sulfur atom independently of the other, and $R^1$ and $R^2$ each denotes an alkyl group or an aryl group independently of the other. The alkyl group or the aryl group may contain a substituent, and hydrogen atoms may be partly or entirely replaced with fluorine atoms.

$R^1—Z—R^2—Z—R^3$ Formula [10]

where Zs each denotes an oxygen atom or a sulfur atom independently of the other, and $R^1$–$R^3$ each denotes an alkyl group or an aryl group independently of the others. $R^1$ and $R^3$ may be hydrogen atoms, if desired. The alkyl group or the aryl group may contain a substituent, and hydrogen atoms may be partly or entirely replaced with fluorine atoms.

The alkyl groups or aryl groups included in the Formulae [1]–[10] may be, but not limited to, any one of the following: $—CH_3$, $—CH_2—CH_3$, $—(CH_2)_5—CH_3$, $—(CH_2)_{10}—CH_3$, $—(CH_2)_{20}—CH_3$, $—(CH_2)_{29}—CH_3$, $—(CH_2)_3=C(CH_3)CH_2—CH_3$, $—(CH_2)_5—C(CH=CH_2)_2—CH_2—CH_3$, $—(CH_2)_6—C(CH_2—CH_2—CH_3)_2—(CH_3)—CH(CH_2—CH_2—CH_2—CH_3)$ $—CH_2—CH_3$, $—CF_2—CF_3$, $—(CF_2)_{10}—CH_3$, $—(CF_2)_3—C(CH_3)=CF—CF_3$, $—(CF_2)_{26}—C(CF_3)_2=CF_3$, $—C_6H_5$, $—C_6H_4(—CH_3)$, $—C_{10}H_7$, $—C_{10}H_5(—CH_2—CH_3)_2$, $—C_{14}H_9$, $—C_{14}H_6(—CH_3)(—CH=CH_2)(—CH_2—CH_2—CH_3)$, $—C_{30}H_{17}$, $—C_6F_5$, $—C_{10}F_5(—CH_{—CH3})_2$, $—C_{10}F_5(—CF_2—CF_3)_2$, $—C_{30}F_{17}$ Substituents which may exist in the above groups include an alkyl group, an aryl group, a heterocyclic group, —Cl, —Br, —I, —OH, —CO, —SH, $—SCH_3$, $—NH_2$, $—N(CH_3)_2$, —NO, $—NO_2$, —NOH, —CHO, —COOH, $—COOH_3$, —CN, —SO, $—PH_2$, $—P(CH_3)_2$ and $—CH_2OCH_3$ by way of example.

The lubricant of the present invention contains 0.01% to 50% of one or both of the compounds represented by the Formulae [1] and [2] for a single component with respect to perfluoropolyether, and contains 0.000001% to 10% of at least one of the compounds having the skeleton represented by the Formula (3)–(10).

A magnetic recording medium of the present invention has the lubricant in the form of a film on a magnetic recording layer or a protection layer. Such a lubricant film deteriorates little even when the medium and a head slider often contact each other at a high speed.

A specific configuration of the magnetic recording medium of the present invention is shown in FIG. 1. As shown, the medium has a substrate 1, an under layer 2 formed on the substrate 2, a magnetic recording layer 3 formed on the under layer 2, and a protection layer 4 formed on the magnetic layer 3. The under layer 2 and protection layer 4 are omissible, if desired. A lubricant layer 5 is formed on the protection layer 4. The present invention is applicable to a magnetic recording medium contacting or likely to contact a record/reproduce head or a head slider, e.g., a hard disk, a floppy disk or a magnetic recording tape.

For the substrate or support, use may be made of any desired nonmagnetic material. For a hard disk, use may be made of aluminum, glass, plastic, carbon or silicon by way of example while, for a floppy disk or a magnetic recording tape, use may be made of polyacetate or similar synthetic resin. The under layer 2 intervening between the substrate 1 and the magnetic recording layer 2 may be formed of Cr, Ni—P or similar material and may be provided with any desired thickness. This is also true with the magnetic recording layer 3. Specifically, the magnetic recording layer 3 may be formed by the painting, plating, vacuum deposition, sputtering or CVD (Chemical Vapor Deposition) of Fe, Co, Ni or similar metal or an oxide thereof, or Co—Ni, Co—Pt, Fe—Ni, Fe—Co—Ni, Co—Cr—Pt—Ta or similar material. The protection layer 4 is also free from limitations and may be implemented by a film of amorphous carbon, hydrogen-added carbon, nitrogen-added carbon, fluorine-added carbon, metal-added carbon, diamond graphite carbon or silicone dioxide.

While the lubricant film 5 may also be formed by any suitable method, a dipping method or a spin coating method may be advantageously applied to a hard disk. The thickness of the lubricant film 5 may be, but not limited to, 1 angstroms to 1,000 angstroms, preferably 5 angstroms to 100 angstroms.

Figure 2:
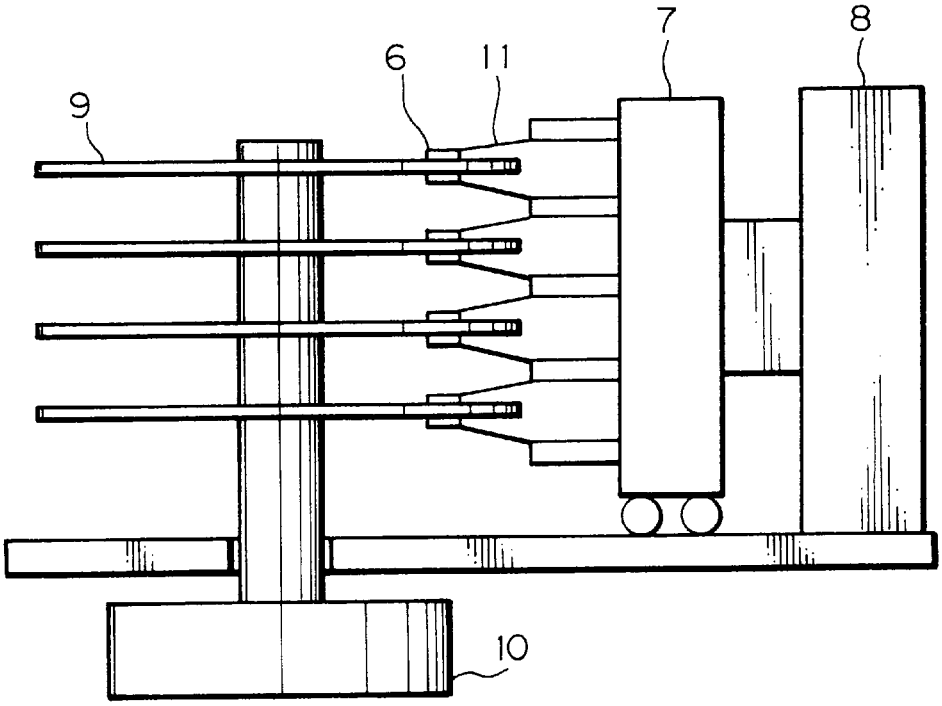
FIG. 2 shows a magnetic recording apparatus using the recording medium of FIG. 1.

FIG. 2 shows a magnetic recording apparatus to which the present invention is applied. As shown, four magnetic disks 9, for example, are stacked at equal intervals and driven by a rotation mechanism 10. At least one of the lubricants particular to the present invention is applied to both sides of each disk 9. Eight magnetic heads 6 in total are arranged such that two of them sandwich one of the disks 9. The heads 6 each is supported by a carriage 7 via a respective support spring 11. The carriage 7 is movable under the control of a head moving mechanism 8.

Preferred embodiments of the present invention will be described hereinafter although the present invention is not limited to the embodiments.

Embodiments 1–15

Embodiments 1–15 are implemented as lubricants each consisting of a compound represented by the Formula (1) and having M=2H and $R^1$–$R^{12}$=$—CH_3$, a compound represented by the Formula [3] and having various substituents introduced in Z=N, $R^1$ and $R^2$, and a perfluoropolyether compound.

(1) Production of Hard Disks i) Production of concentration samples: 10 mg of, among compounds (additives 1) represented by the Formula (1), one having a molecular structure of M=2H and $R^1$–$R^{12}$=$—CH_3$ and 0.01 mg of, among compounds (additives 2) represented by the Formula [3], one having a molecular structure of Z=N, $R^1$=$—(CH_2)_{10}—CH_3$ and $R_2$=$CH(CH_2)_{10}—CH_3$ were dissolved in 10 ml of methylethyl ketone. The resulting solution was added to 10 g of Fonbrine Z-DOL (trade name) available from Montefluos and then sufficiently stirred. The mixture was dried at 80° C. for 30 minutes under reduced pressure in order to remove methylehtyl ketone. As a result, a lubricant was produced.

The above lubricant was dissolved in a fluorocarbon solvent Florinate FC-77 (trade name) available from Sumitomo 3M to prepare a 0.08% solution. This solution was applied by conventional dipping to a disk having a carbon protection layer formed thereon by sputtering, thereby producing a sample disk provided with a lubricant film. Such a procedure was repeated to produce other sample disks having lubricant films in which the additives 1 and additives 2 respectively had concentrations between 0.1% and 50% and 0.000001%.

The sample disks each had the structure shown in FIG. 1. In each sample disk, the substrate was implemented by an aluminum substrate having a diameter of 3.5 inches and so roughened as to have lugs of less than 1.5 inch. An Ni—P under layer was formed on the rough surface of the aluminum substrate, and then a magnetic layer was formed on the under layer. Subsequently, a 10 nm thick protection layer of hydrogen-added carbon was formed on the magnetic layer by sputtering. A 20 angstrom thick lubricant film was formed on the protection layer by dipping.

ii) Production of additive sample disks: The additives 1 and 2 were respectively implemented by a compound having M═2H and $R^1$–$R^{12}$═—$CH_3$ and a compound having various substituents introduced in Z═N, $R^1$ and $R^2$. The concentrations of the additive 1 and 2 were respectively fixed at 10% and 0.000001%, whereby additive sample disks were produced.

iii) Production of a conventional disk: For comparison, a sample disk was produced by forming a lubricant film containing 0.1% of tri-n-undecyleamine $N((CH_2)_{10}—CH_3)_3$ which is one of alkylamines taught in Laid-Open Publication No. 5-20675 mentioned earlier.

iv) Production of a reference disk: A reference disk was produced by exactly the same procedure except that no additives were added.

(2) Lubrication Test

The additive sample disks, conventional disk and reference disk were evaluated as to lubricating ability by a CSS test and a seek test under conditions listed in FIG. 3. For the CSS test, a slider was so adjusted as to press itself against a disk surface with a preselected load and fixed in place so as not to move radially inward or outward. The rotation speed of the disk was increased from 0 rpm to 3,600 rpm (with the slider floating 5 nm above the disk) and immediately reduced to 0 rpm. Such a cycle was repeated 20,000 consecutive times in order compare the resulting coefficient of friction $\mu$ with the initial coefficient friction $\mu$. The slider was implemented as a double rail type nanoslider (50% slider) formed of $Al_2O_3$; a 10 nm thick DLC protection layer was formed on ABS (sliding surfaces).

During the seek test, each disk and slider were mounted in the same manner as during the CSS test. While the disk was caused to spin at 2,600 rpm constantly, the slider was repeatedly moved from the outer end to the inner end and then from the inner end to the outer end of the disk at a high speed. This test was continued for 72 hours. After the test, the amount of deposits on the sliding surface of the slider was measured by eye. For the measurement, the area of the sliding surface covered with the deposits was evaluated by use of eleven different points. Specifically, the above area was provided with point 0 if entirely free from deposits, provided with point 1 if covered with deposits over less than 1%, and provided with point 2 if covered with deposits over more than 1%, but less than 2%. In the same manner, the area was provided with point 10 if covered with deposits over more than 10%.

(3) Relation between Additive Concentration and Lubricating Ability

FIG. 4 shows the results of evaluation effected with the additive 1 concentration sample disks as to lubricating ability. As shown, the lubricant of Embodiment 1 reduced the increase in the coefficient of friction and therefore the deposits on the slider $\mu$ after CSS when the concentrations of the additives 1 and 2 were respectively between 0.1% and 50% and 0.000001%.

(4) Relation between Kind of Additive and Lubricating Ability

Lubricating ability of the additive sample disks and that of the conventional disk were evaluated under the conditions shown in FIG. 3. FIG. 5 shows the kinds of additives and the results of evaluation. As shown, the lubricants each consisting of the compound represented by the Formula [1] and having M═2H and $R^1$–$R^{12}$═—$CH_3$, the compound represented by the Formula [3] and having various substituents introduced in Z═N, $R^1$ and $R^2$ and the perfluoropolyether compound reduced the increase in the coefficient of friction $\mu$ and therefore the deposits on the slider after CSS when the concentrations of the additives 1 and 2 were respectively between 0.1% and 50% and 0.000001%. By contrast, under the same conditions for evaluation, the lubricant taught in Laid-Open Publication No. 5-20675 could not achieve a high lubricating ability or reduce the deposits on the head.

Embodiments 16–25

Embodiments 16–25 are implemented as lubricants each consisting of a compound represented by the Formula (1) and having M═Ti and $R^1$–$R^{12}$═—$CH_2CH_3$, a compound represented by the Formula [4] and having various substituents introduced in Z═P and R, and a perfluoropolyether compound.

Concentration sample disks, additive sample disks, a conventional disk and a reference disk were prepared in the same manner as in Embodiments 1–15 so as to determine a relation between the concentrations and kinds of the additives and the lubricating ability. For the concentration sample disks, the additive 1 was implemented by, among the compounds represented by the Formula [1], one having M═Ti and $R^1$–$R^2$═—$CH_2CH_3$ while the additive 2 was implemented by, among the compounds represented by the Formula [4], one having Z═P and R═≡$C(CH_2)_{20}$—$CH_3$. The concentration of the additive 1 ranged from 0% to 50% while the concentration of the additive 2 was fixed at 0.00001%. For the additive samples, the additive 1 used for the concentration samples was also used while the additive 2 was implemented by a compound having various substituents introduced in R; the concentrations of the additives 1 and 2 were fixed at 10% and 0.00001%, respectively.

FIG. 6 shows conditions for evaluation. FIG. 7 shows the results of evaluation effected with the concentration sample disks as to lubricating ability while FIG. 8 shows the results of evaluation effected with the additive sample disks. As FIG. 7 indicates, Embodiment 16 reduces the increase in the coefficient of friction $\mu$ and therefor the deposits on the slider after CSS when the concentrations of the additives 1 and 2 were between 0.1% and 50% and 0.00001%, respectively. As FIG. 8 indicates, the lubricant consisting of the compound represented by the Formula [1] and having M═Ti and $R^1$–$R^{12}$═—$CH_2CH_3$, the compound represented by the formula [4] and having various substituents introduced in R, and perfluoropolyether compound reduced the increase in the coefficient of friction $\mu$ and therefore the deposits on the slider after CSS when the concentrations of the additives 1 and 2 were between 0.1% and 50% and 0.00001%, respectively. By contrast, under the same conditions for evaluation, the lubricant taught in Laid-Open Publication No. 5-20675 could not achieve a high lubricating ability or reduce the deposits on the head.

Embodiments 26–40

Embodiments 26–40 are implemented as lubricants each consisting of a compound represented by the Formula (1) and having M=V, $R^1$–$R^8$=—$CH_2CH_3$ and $R^9$–$R^{12}$=—$C_6H_5$, a compound represented by the Formula [5] and having various substituents introduced in Z=P and $R^1$–$R^4$, and a perfluoropolyether compound.

Concentration sample disks, additive sample disks, a conventional disk and a reference disk were prepared in the same manner as in Embodiments 1–15 so as to determine a relation between the concentrations and kinds of the additives and the lubricating ability. For the concentration sample disks, the additive 1 was implemented by, among the compounds represented by the Formula [1], one having M=V, $R^1$–$R^8$=—$CH_2CH_3$ and $R^9$–$R^{12}$=—$C_6H_5$ while the additive 2 was implemented by, among the compounds represented by the Formula [5], one having Z=P and $R^1$–$R^4$=—$(CH_2)_{10}$—$CH_3$. The concentration of the additive 1 ranged from 0% to 50% while the concentration of the additive 2 was fixed at 0.0001%. For the additive sample disks, the additive 1 used for the concentration sample disks was also used while the additive 2 was implemented by a compound having various substituents introduced in $R^1$–$R^4$; the concentrations of the additives 1 and 2 were fixed at 10% and 0.0001% respectively.

FIG. 9 shows conditions for evaluation. FIG. 10 shows the results of evaluation effected with the concentration sample disks as to lubricating ability while FIG. 11 shows the results of evaluation effected with the additive sample disks. As FIG. 10 indicates, Embodiment 26 reduced the increase in the coefficient of friction $\mu$ and therefor the deposits on the slider after CSS when the concentrations of the additives 1 and 2 were between 0.1% and 50% and 0.0001%, respectively. As FIG. 11 indicates, the lubricant consisting of the compound represented by the Formula [1] and having M=V, $R^1$–$R^8$=—$CH_2H_3$ and $R^9$–$R^{12}$=—$C_6H_5$, the compound represented by the formula [5] and having various substituents introduced in Z=P and R, and perfluoropolyether compound reduced the increase in the coefficient of friction $\mu$ and therefore the deposits on the slider after CSS when the concentrations of the additives 1 and 2 were between 0.1% and 50% and 0.0001%, respectively. By contrast, under the same conditions for evaluation, the lubricant taught in Laid-Open Publication No. 5-20675 could not achieve a high lubricating ability or reduce the deposits on the head.

Embodiments 41–55

Embodiments 41–55 are implemented as lubricants each consisting of a compound represented by the Formula [1] and having M=Cr and $R^1$–$R^{12}$=—$C_6H_5$, a compound represented by the Formula [6] and having various substituents introduced in Z=N and $R^1$–$R^5$, and a perfluoropolyether compound.

Concentration sample disks, additive sample disks, a conventional disk and a reference disk were prepared in the same manner as in Embodiments 1–15 so as to determine a relation between the concentrations and kinds of the additives and the lubricating ability. For the concentration sample disks, the additive 1 was implemented by, among the compounds represented by the Formula [1], one having M=Cr and $R^1$–$R^{12}$=—$C_6H_5$ while the additive 2 was implemented by, among the compounds represented by the Formula [6], one having Z=N, $R^1$=$R^2$=$R^4$=$R^5$=—$(CH_2)_{10}$—$CH_3$ and $R^3$=—$(CH_2)_{10}$—. The concentration of the additive 1 ranged from 0% to 50% while the concentration of the additive 2 was fixed at 0.001%. For the additive sample disks, the additive 1 used for the concentration sample disks was also used while the additive 2 was implemented by a compound having various substituents introduced in $R^1$–$R^5$; the concentrations of the additives 1 and 2 were fixed at 10% and 0.001%, respectively.

FIG. 12 shows conditions for evaluation. FIG. 13 shows the results of evaluation effected with the concentration sample disks as to lubricating ability while FIG. 14 shows the results of evaluation effected with the additive sample disks. As FIG. 13 indicates, Embodiment 41 reduced the increase in the coefficient of friction $\mu$ and therefor the deposits on the slider after CSS when the concentrations of the additives 1 and 2 were between 0.1% and 50% and 0.001%, respectively. As FIG. 14 indicates, the lubricant consisting of the compound represented by the Formula [1] and having M=Cr and $R^1$–$R^{12}$=—$C_6H_5$, the compound represented by the formula [6] and having various substituents introduced in Z=N and $R^1$–$R^5$, and perfluoropolyether compound reduced the increase in the coefficient of friction $\mu$ and therefore the deposits on the slider after CSS when the concentrations of the additives 1 and 2 were between 0.1% and 50% and 0.001%, respectively. By contrast, under the same conditions for evaluation, the lubricant taught in Laid-Open Publication No. 5-20675 could not achieve a high lubricating ability or reduce the deposits on the head.

Embodiments 56–70

Embodiments 56–70 are implemented as lubricants each consisting of a compound represented by the Formula [2] and having M=2H and $A^1$–$A^4$=benzene ring, a compound represented by the Formula [7] and having various substituents introduced in Z=O, $R^1$ and $R^2$, and a perfluoropolyether compound.

Concentration sample disks, additive sample disks, a conventional disk and a reference disk were prepared in the same manner as in Embodiments 1–15 so as to determine a relation between the concentrations and kinds of the additives and the lubricating ability. For the concentration sample disks, the additive 1 was implemented by, among the compounds represented by the Formula [2], one having M=2H and $A^1$–$A^4$=benzene ring while the additive 2 was implemented by, among the compounds represented by the Formula [7], one having Z=O and $R^1$=$R^2$=—$(CH_2)_{10}$—$CH_3$. The concentration of the additive 1 ranged from 0% to 50% while the concentration of the additive 2 was fixed at 0.01%. For the additive sample disks, the additive 1 used for the concentration sample disks was also used while the additive 2 was implemented by a compound having various substituents introduced in $R^1$ and $R^2$; the concentrations of the additives 1 and 2 were fixed at 10% and 0.01%, respectively.

FIG. 15 shows conditions for evaluation. FIG. 16 shows the results of evaluation effected with the concentration sample disks as to lubricating ability while FIG. 17 shows the results of evaluation effected with the additive sample disks. As FIG. 16 indicates, Embodiment 56 reduced the increase in the coefficient of friction $\mu$ and therefor the deposits on the slider after CSS when the concentrations of the additives 1 and 2 were between 0.1% and 50% and 0.01%, respectively. As FIG. 17 indicates, the lubricant consisting of the compound represented by the Formula [2] and having M=2H and $R^1$–$R^4$=benzene ring, the compound represented by the formula [7] and having various substituents introduced in Z=O, $R^1$ and $R^2$, and perfluoropolyether compound reduced the increase in the coefficient of friction $\mu$ and therefore the deposits on the slider after CSS when the concentrations of the additives 1 and 2 were between 0.1% and 50% and 0.01%, respectively. By contrast, under the same conditions for evaluation, the lubricant taught in Laid-Open Publication No. 5-20675 could not achieve a high lubricating ability or reduce the deposits on the head.

Embodiments 71–80

Embodiments 71–80 are implemented as lubricants each consisting of a compound represented by the Formula [2] and having M=Mn and $A^1$–$A^4$=naphthalene ring, a compound represented by the Formula [8] and having various substituents introduced in Z=S and R, and a perfluoropolyether compound.

Concentration sample disks, additive sample disks, a conventional disk and a reference disk were prepared in the same manner as in Embodiments 1–15 so as to determine a relation between the concentrations and kinds of the additives and the lubricating ability. For the concentration sample disks, the additive 1 was implemented by, among the compounds represented by the Formula [2], one having M=Mn and $A^1$–$A^4$=naphthalene ring while the additive 2 was implemented by, among the compounds represented by the Formula [8], one having Z=S and $R^1$=—$CH(CH_2)_{10}$—$CH_3$. The concentration of the additive 1 ranged from 0% to 50% while the concentration of the additive 2 was fixed at 0.1%. For the additive sample disks, the additive 1 used for the concentration sample disks was also used while the additive 2 was implemented by a compound having various substituents introduced in R; the concentrations of the additives 1 and 2 were fixed at 10% and 0.1%, respectively.

FIG. 18 shows conditions for evaluation. FIG. 19 shows the results of evaluation effected with the concentration sample disks as to lubricating ability while FIG. 20 shows the results of evaluation effected with the additive sample disks. As FIG. 19 indicates, Embodiment 71 reduced the increase in the coefficient of friction $\mu$ and therefore the deposits on the slider after CSS when the concentrations of the additives 1 and 2 were between 0.1% and 50% and 0.1%, respectively. As FIG. 20 indicates, the lubricant consisting of the compound represented by the Formula [2] and having M=Mn and $R^1$–$R^4$=naphthalene ring, the compound represented by the formula [8] and having various substituents introduced in Z=S and R, and perfluoropolyether compound reduced the increase in the coefficient of friction $\mu$ and therefore the deposits on the slider after CSS when the concentrations of the additives 1 and 2 were between 0.1% and 50% and 0.1%, respectively. By contrast, under the same conditions for evaluation, the lubricant taught in Laid-Open Publication No. 5-20675 could not achieve a high lubricating ability or reduce the deposits on the head.

Embodiment 81–95

Embodiments 81–95 are implemented as lubricants each consisting of a compound represented by the Formula [2] and having M=Fe and $A^1$–$A^4$=anthacene ring, a compound represented by the Formula [9] and having various substituents introduced in Z=Se and $R^1$ and $R^2$, and a perfluoropolyether compound.

Concentration sample disks, additive sample disks, a conventional disk and a reference disk were prepared in the same manner as in Embodiments 1–15 so as to determine a relation between the concentrations and kinds of the additives and the lubricating ability. For the concentration sample disks, the additive 1 was implemented by, among the compounds represented by the Formula [2], one having M=Fe and $A^1$–$A^4$=anthracene ring while the additive 2 was implemented by, among the compounds represented by the Formula [9], one having Z=Se and $R^1$=$R^2$=—$CH(CH_2)_{10}$—$CH_3$. The concentration of the additive 1 ranged from 0% to 50% while the concentration of the additive 2 was fixed at 1%. For the additive sample disks, the additive 1 used for the concentration sample disks was also used while the additive 2 was implemented by a compound having various substituents introduced in $R^1$ and $R^2$; the concentrations of the additives 1 and 2 were fixed at 10% and 1%, respectively.

FIG. 21 shows conditions for evaluation. FIG. 22 shows the results of evaluation effected with the concentration sample disks as to lubricating ability while FIG. 23 shows the results of evaluation effected with the additive sample disks. As FIG. 22 indicates, Embodiment 81 reduced the increase in the coefficient of friction $\mu$ and therefore the deposits on the slider after CSS when the concentrations of the additives 1 and 2 were between 0.1% and 50% and 1%, respectively. As FIG. 23 indicates, the lubricant consisting of the compound represented by the Formula [2] and having M=Fe and $R^1$–$R^4$=anthracene ring, the compound represented by the formula [9] and having various substituents introduced in Z=Se, $R^1$ and $R^2$, and perfluoropolyether compound reduced the increase in the coefficient of friction $\mu$ and therefore the deposits on the slider after CSS when the concentrations of the additives 1 and 2 were between 0.1% and 50% and 1%, respectively. By contrast, under the same conditions for evaluation, the lubricant taught in Laid-Open Publication No. 5-20675 could not achieve a high lubricating ability or reduce the deposits on the head.

Embodiments 96–110

Embodiments 96–110 are implemented as lubricants each consisting of a compound represented by the Formula [2] and having M=Ru and $A^1$–$A^4$=perfluoropyrene ring, a compound represented by the Formula [10] and having various substituents introduced in Z=O and $R^1$–$R^3$, and a perfluoropolyether compound.

Concentration sample disks, additive sample disks, a conventional disk and a reference disk were prepared in the same manner as in Embodiments 1–15 so as to determine a relation between the concentrations and kinds of the additives and the lubricating ability. For the concentration sample disks, the additive 1 was implemented by, among the compounds represented by the Formula [2], one having M=Ru and $A^1$–$A^4$=perfluoropyrene ring while the additive 2 was implemented by, among the compounds represented by the Formula [10], one having Z=O, $R^1$=$R^3$=—$(CH_2)_{10}$—$CH_3$, and $R^2$=—$(CH_2)_{10}$—. The concentration of the additive 1 ranged from 0% to 50% while the concentration of the additive 2 was fixed at 10%. For the additive sample disks, the additive 1 used for the concentration sample disks was also used while the additive 2 was implemented by a compound having various substituents introduced in $R^1$–$R^3$; the concentrations of the additives 1 and 2 were fixed at 10% and 10%, respectively.

FIG. 23 shows conditions for evaluation. FIG. 24 shows the results of evaluation effected with the concentration sample disks as to lubricating ability while FIG. 25 shows the results of evaluation effected with the additive sample disks. As FIG. 24 indicates, Embodiment 96 reduced the increase in the coefficient of friction $\mu$ and therefore the deposits on the slider after CSS when the concentrations of the additives 1 and 2 were between 0.1% and 50% and 10%, respectively. As FIG. 25 indicates, the lubricant consisting of the compound represented by the Formula [2] and having M═Ru and $R^1$–$R^4$=perfluoropyrene ring, the compound represented by the formula [10] and having various substituents introduced in Z═O and $R^1$–$R^2$, and perfluoropolyether compound reduced the increase in the coefficient of friction $\mu$ and therefore the deposits on the slider after CSS when the concentrations of the additives 1 and 2 were between 0.1% and 50% and 10%, respectively. By contrast, under the same conditions for evaluation, the lubricant taught in Laid-Open Publication No. 5-20675 could not achieve a high lubricating ability or reduce the deposits on the head.

Various modifications will become possible for those skilled in the art after receiving the teachings of the present disclosure without departing from the scope thereof.

What is claimed is:

1. A lubricant for a magnetic recording medium comprising:

a perfluoropolyether compound;

0.1 wt % to 50 wt % of at least one compound selected from the group represented by following formulae (1) and (2); and 0.000001 wt % to 10 wt % of at least one compound selected from the group having skeletons represented by following formulae (3)–(10):

Formula (1)

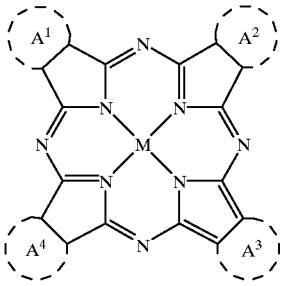

where M denotes one metal ion or two hydrogen ions, and $A^1$–$A^4$ each denotes independently of the others a condensed polycyclic compound residual group containing either cyclic ketone or cyclic secondary amine in which a carbonyl group or an imino group is substituted for at least one methine carbon atom contained in a condensed polycyclic compound residual group of one or more benzene rings and a benzene ring, naphthalene ring, acenaphthylene ring, fluorene ring, phenalene ring, anthracene ring, fluoranthene ring, acephenanthrylene ring, triphenine ring, pyrene ring, chrysene ring, naphthacene ring, pleiadene ring, picene ring, perillene ring, pentaphene ring, pentacene ring, hexene ring, chlonene ring or heptacene ring or a compound residual group thereof, or each denotes independently of the others a complex cyclic compound residual group in which the methine carbon atom of the condensed cyclic compound residual group is replaced with one or more nitrogen atoms, oxygen atoms or sulfur atoms of the same or different kinds; the hydrogen atoms of the condensed polycyclic compound residual group or those of the heterocyclic compound residual group may be replaced with an alkyl group or an aryl group; the alkyl group or the aryl group may include a substituent, and the hydrogen atoms may be partly or entirely replaced with fluorine atoms;

Formula (2)

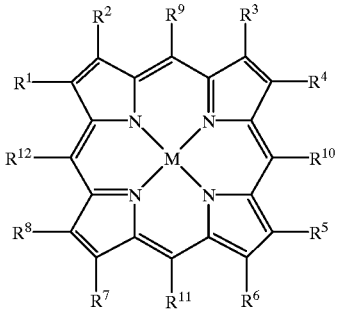

where $R^1$–$R^{12}$ each denotes one of a hydrogen atom, an alkyl atom, and an aryl atom; an alkyl group or an aryl group may contain a substituent, and the hydrogen atoms may be partly or entirely replaced with fluorine atoms;

Formula (3)

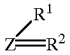

where Z denotes a nitrogen atom or a phosphor atom, and $R^1$ denotes a hydrogen atom, an alkyl group or an aryl group; the alkyl group or the aryl group may contain a substituent, and hydrogen atoms may be partly or entirely replaced with fluorine atoms; $R^2$ denotes an alkyl group or an aryl group which may contain a substituent; hydrogen atoms may be partly or entirely replaced with fluorine atoms;

Z≡R Formula (4)

where Z denotes a nitrogen atom or a phosphor atom; and R denotes an alkyl group or an aryl group; the alkyl group or the aryl group may contain a substituent, and hydrogen atoms may be partly or entirely replaced with fluorine atoms;

Formula (5)

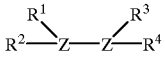

where Zs each denotes a nitrogen atom or a phosphor atom independently of the other, and $R^1$–$R^4$ each denotes a hydrogen atom, an alkyl group or an aryl group independently of the others; the alkyl group or the aryl group may contain a substituent, and hydrogen atoms may be partly or entirely replaced with fluorine atoms;

Formula (6)

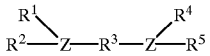

where Zs each denote a nitrogen atom or a phosphor atom independently of the other, and $R^1$–$R^5$ each denotes an alkyl group or an aryl group independently of the others; $R^1$, $R^2$, $R^4$ and $R^5$ may each be a hydrogen atom; the alkyl group or the aryl group may each contain a substituent, and hydrogen atoms may be partly or entirely replaced with fluorine atoms;

$R^1$—Z—$R^2$ Formula (7)

where Z denotes an oxygen atom or a sulfur atom, and $R^1$ and $R^2$ each denotes a hydrogen atom, an alkyl group or an aryl group independently of the other; the alkyl group or the aryl group may contain a substituent, and hydrogen atoms may be partly or entirely replaced with fluorine atoms;

Z═R Formula (8)

where Z denotes an oxygen atom or a sulfur atom, and R denotes an alkyl group or an aryl group; the alkyl group or the aryl group may contain a substituent, and hydrogen atoms may be partly or entirely replaced with fluorine atoms; and $R^1$—Z—Z—$R^2$ Formula (9)

where Zs each denotes an oxygen atom or a sulfur atom independently of the other, and $R^1$ and $R^2$ each denotes an alkyl group or an aryl group independently of the other; the alkyl group or the aryl group may contain a substituent, and hydrogen atoms may be partly or entirely replaced with fluorine atoms.

2. A magnetic recording medium comprising a substrate and a magnetic film formed on said substrate either directly or via an under layer, and a lubricant applied to said magnetic film either directly or via a protection layer, wherein said lubricant is the lubricant as claimed in claim 1.

3. A magnetic recording medium as claimed in claim 2, wherein the under layer is formed of Ni—P or Cr.

4. A magnetic recording medium as claimed in claim 2, wherein the protection layer is formed of hydrogen-added carbon or hydrogen- and nitrogen-added carbon.

5. A magnetic recording medium as claimed in claim 2, wherein said magnetic film is formed on said substrate via an under layer.

6. A magnetic recording medium as claimed in claim 2, wherein said lubricant is applied to form a film of 1 Å to 1,000 Å thick.

7. A magnetic recording medium as claimed in claim 2, wherein said lubricant is applied to form a film of 5 Å to 100 Å thick.

8. A lubricant for a magnetic recording medium as claimed in claim 1, wherein said perfluoropolyether compound has a main chain comprising a group selected from the group consisting of formulae (11), (12) and (13), $$—CF_2—(O—CF_2—CF_2)p—(O—CF_2)q—O—CF_2— \quad (11)$$

$$F—(CF_2—CF_2—CF_2)n—CF_2—CF_2— \quad (12)$$

$$CF_3—(O—CF—(CF_3)—CF_2)m—(O—CF_2)l— \quad (13)$$

where p, q, n, m and l each is an integer of 1 or greater.

* * * * *